US006199418B1

(12) United States Patent
Tezuka

(10) Patent No.: US 6,199,418 B1
(45) Date of Patent: Mar. 13, 2001

(54) FLATNESS CONTROL APPARATUS FOR A HOT ROLLING MILL

(75) Inventor: Tomoyuki Tezuka, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/356,710

(22) Filed: Jul. 20, 1999

(30) Foreign Application Priority Data

Aug. 25, 1998 (JP) ..... 10-239226

(51) Int. Cl.[7] ..... B21B 37/28
(52) U.S. Cl. ..... 72/9.1; 72/11.7
(58) Field of Search ..... 72/8.9, 9.1, 11.6, 72/11.7, 12.7, 12.8

(56) References Cited

U.S. PATENT DOCUMENTS 5,126,947 6/1992 Koyama .
5,509,285 * 4/1996 Anbe ..... 72/9.1
5,740,686 * 4/1998 Martinetz ..... 72/11.6
5,960,657 * 10/1999 Anbe et al. ..... 72/11.7

FOREIGN PATENT DOCUMENTS 3-266007 * 11/1991 (JP) ..... 72/9.1
6-71319 * 3/1994 (JP) ..... 72/8.9

OTHER PUBLICATIONS

"Advanced Technology for Strip Rolling" (in Japanese), Corona Publishing Co. Ltd.; The Japan Society for Technology of Plasticity, 1993, pp. 182–183.

* cited by examiner

*Primary Examiner*—Ed Tolan
(74) *Attorney, Agent, or Firm*—Oblon, Spivak, McClelland, Maier & Neustadt, P.C.

(57) ABSTRACT

A flatness control apparatus for controlling the flatness of a strip in a hot rolling mill, wherein a strip width meter measures center line error values of the strip. The center line error values are the offsets of the center of the strip from the center of the hot rolling mill line and are positive if the center of the strip is offset toward a drive side of the mill. A flatness meter, installed on the delivery side of the mill, measures flatness of the strip at positions specified by the flatness control apparatus. Based on the center line error values and the flatness measurements, the flatness control apparatus calculates adjustments to be made to a work roll bending apparatus on a final stand in the mill in order to control strip flatness.

16 Claims, 6 Drawing Sheets

FLATNESS CONTROL APPARATUS FOR A HOT ROLLING MILL

BACKGROUND OF THE INVENTION

1. Field of the invention

This invention relates to a flatness control apparatus for a hot rolling mill which controls strip flatness.

2. Description of the Related Art

In a general flatness control apparatus for a hot rolling mill, manipulated actuator values for the rolling mill are determined based on flatness reference values and measured values of flatness meter equipped on the delivery side of the final stand. The position which measures strip flatness is defined the center of strip width as the center of line of rolling mill.

The flatness control apparatus is almost satisfactory when the center of the strip correspond with the center of line. However, in fact there is always no strip in the center of line. The strip is approached at the drive side, the side of the motor of rolling mill, or at the operator side, the side of monitoring room which supervises the rolled strip situation. In such a case, the position which strip flatness is measured by the flatness meter will be different from the actually measured position. It was difficult to control to flatness reference values and that is low accurate for controlling flatness.

SUMMARY OF THE INVENTION

The present invention is for solving above subject, and aims at providing flatness control apparatus for a hot rolling mill which is high accuracy and can control strip flatness when there is no strip in the center of line.

In accordance with the present invention, the foregoing objects, among others, are achieved by providing a flatness control apparatus for a hot rolling mill comprising a strip width meter, installed on an entry side of the hot rolling mill, for measuring center line error values of a strip; a flatness meter, installed on a delivery side of the hot rolling mill, for measuring flatness of the strip ;an actuator installed near the mill, for controlling flatness of the strip; a controller measures by the flatness meter based on center line error values measured and pre-set strip width values ; a controller determines deviations between measured flatness values and pre-set flatness reference values ;a controller determines correction actuator values based on the deviations ; and a controller determines manipulated actuator values based on the correction actuator values.

BRIEF DESCRIPTION OF THE DRAWINGS

A more complete appreciation of the present invention and many of its attendant advantages will be readily obtained by reference to the following detailed description considered in connection with the accompanying drawings, in which.

DETAILED DESCRIPTION OF THE PREFERRED EMBODIMENTS

Figure 1:
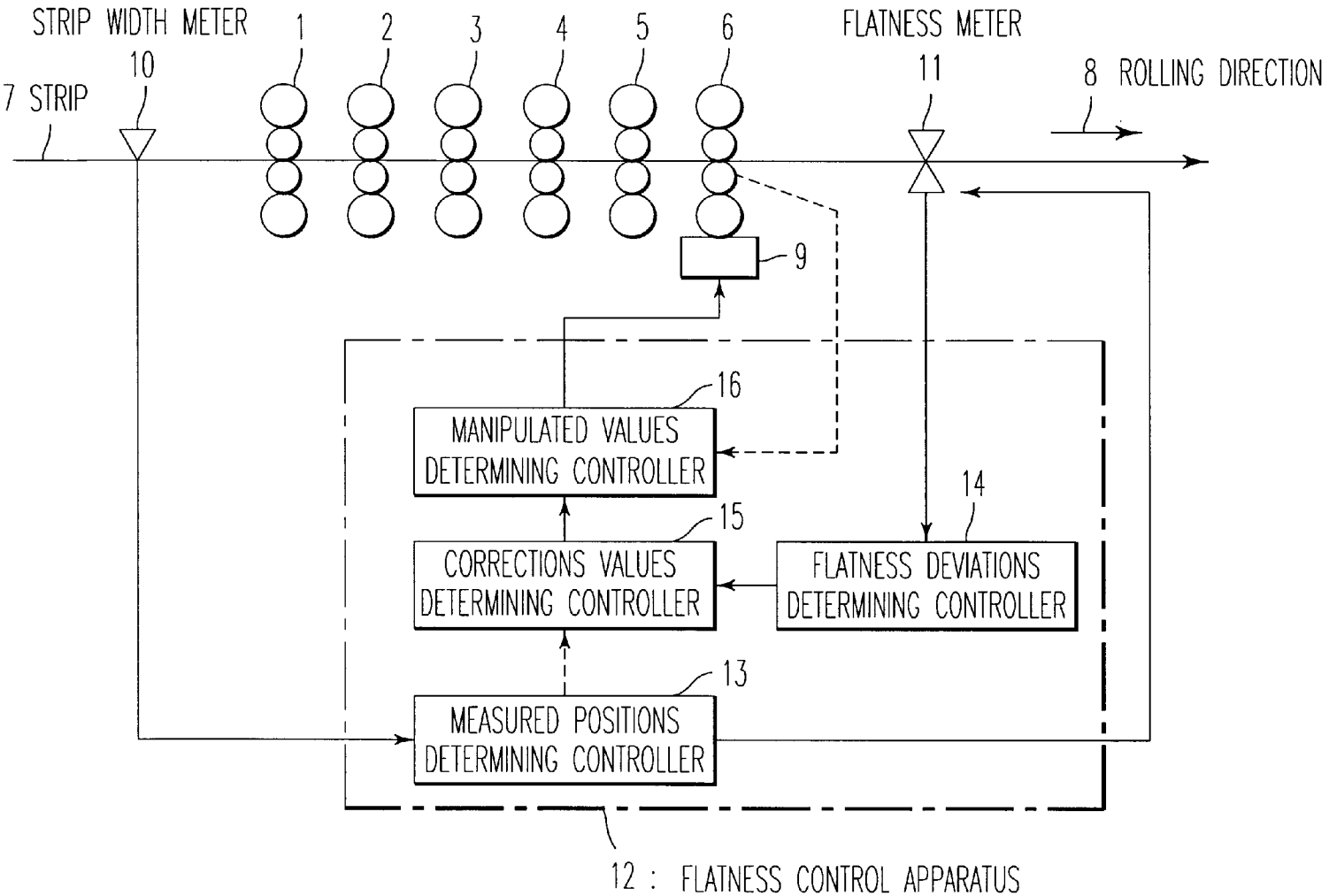
FIG. 1 is a block diagram showing the first embodiment of the present invention with rolling mill for application.

FIG. 1 is a block diagram showing the first embodiment of the present invention with rolling mill for application.

In FIG. 1, A hot rolling mill comprises four-high mills of 6 stands arranged in tandem. A strip 7 is rolled in the direction of the arrow 8.

An actuator 9 for controlling flatness is the same as that of actuator for controlling strip crown. The stand 1–6 or, two or more stands are equipped with the actuator for controlling the strip flatness and strip crown. In order to carry out the present invention, it is necessary that one stand is equipped with the actuator for controlling flatness.

The following explanation is the case where it has high response work roll bending apparatus 9 as actuator for the rolling mill 6, the final stand, for example.

A Strip width meter 10 measures center line error values of the strip is installed on the entry side of the stand 1. A strip width meter 10 measures center line error values of the strip 7 before the strip 7 enters the stand 1. The measured center line error values of the strip 7 is supplied to flatness control apparatus 12.

A flatness meter 11 measures the flatness of the strip 7 on the position specified by the flatness control apparatus l2 is installed on the delivery side of the stand 6. The measured flatness is also supplied to the flatness control apparatus 12.

The flatness control apparatus 12 calculates manipulated values of a work roll bending apparatus 9 of the final stand, rolling mill 6, based on the center line error values measured by the strip width meter 10 and the flatness measured by the flatness meter 11. The manipulated values of the work roll bending apparatus 9 of the final stand is added to the workroll bending apparatus 9. The strip flatness is controlled by the work roll bending apparatus 9.

The flatness control apparatus 12 is constituted by the measured positions determining controller 13, a flatness deviations determining controller 14, corrections values determining controller 15, and a manipulated values determining controller 16.

The measured position determining controller 13 calculates the suitable position of the strip 7 measured by the flatness meter 11, based on the center line error values measured by strip width meter 10 and pre-set strip width, transmits it to the flatness meter 11. If the strip 7 is rolled by the rolling mill and arrives at the position of the flatness meter 11 on the delivery side of the mill 6, the strip 7 is measured by flatness meter 11 on the specified positions to measure.

The flatness deviations determining controller 14 determines the flatness deviations based on measured values of the flatness meter 11 and target pre-set flatness. The flatness deviations is added to the corrections values determining controller 15.

The correction values determining controller 15 determines correction values of work roll bending apparatus 9 based on the flatness deviations, corresponding to the positions to measure by the measured positions determining controller 13. The manipulated values determining controller 16 determines manipulated values of work roll bending apparatus 9 based on the correction values and the manipulated values is added to work roll bending apparatus 9.

The above first embodiment is explained from FIG. 1 to FIG. 5. Usually, the flatness of the strip 7 is measured in two or more positions in the strip width direction. The work roll bending apparatus 9 is controlled by the flatness control apparatus 12 based on the measured flatness values.

Figure 2:
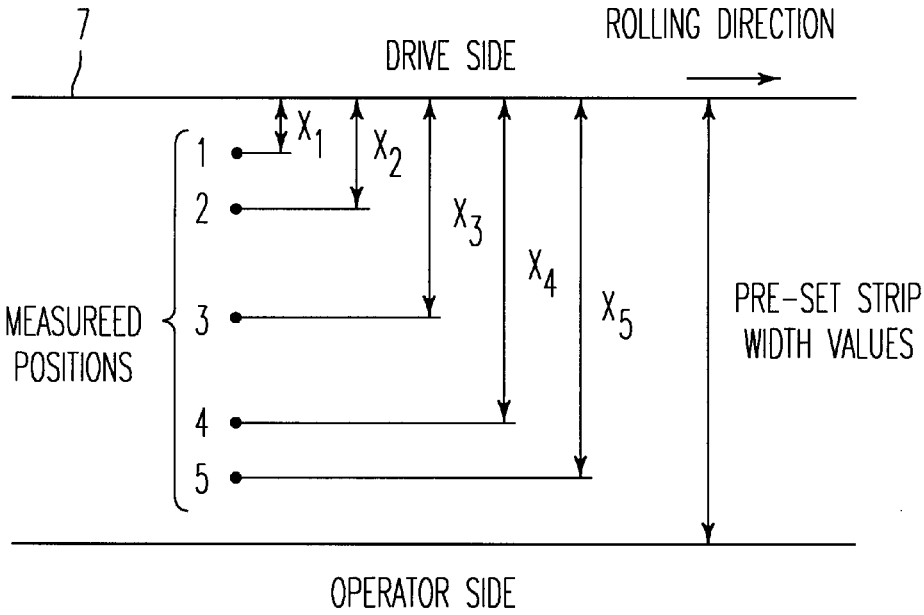
FIG. 2 is showing flatness measuring position in order to explain operation of the 1st embodiment.
Figure 3:
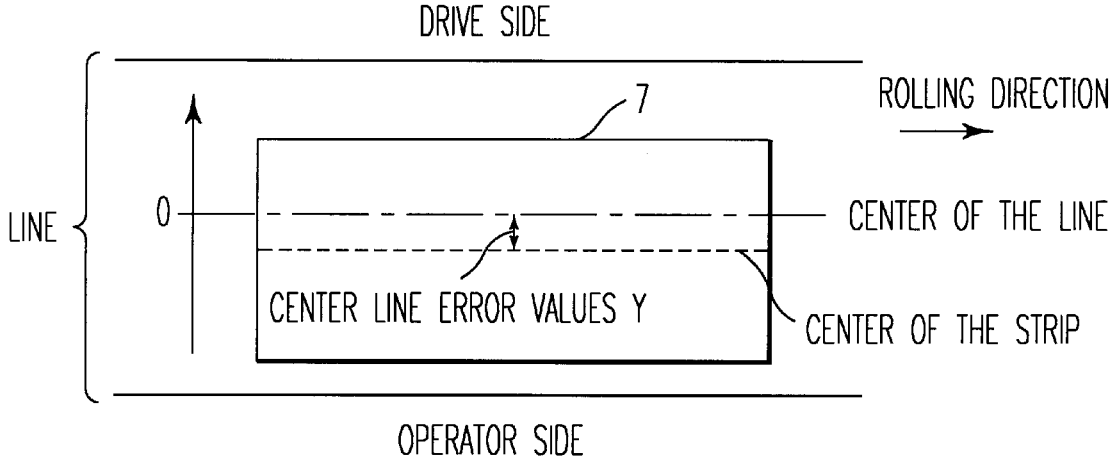
FIG. 3 is showing the relation of line and strip position in order to explain operation of the 1st embodiment.

In the following explanation, as shown in FIG. 2, the measured position is 5 places of the distance of x1, x2, x3, x4, and x5 from the end of the strip 7, the side of a drive of the strip 7.

However, the method to decide the measured position and the number to measure are not limited to this.

As the strip 7 arrives at the position of strip width meter 10, the strip width meter 10 measures center line error values "y" as shown in FIG. 2. The center line error values y is given by the difference between the center of the line and the center of the strip and it is in the positive direction as the strip is at the drive side of the mill. The measured positions are determined the equations 1–5 based on center line error values y and pre-set strip width w by the measured positions determining means 13:

$$y1 = \frac{1}{2} \cdot w - x1 + y \tag{1}$$

$$y2 = \frac{1}{2} \cdot w - x2 + y \tag{2}$$

$$y3 = \frac{1}{2} \cdot w - x3 + y \tag{3}$$

$$y4 = \frac{1}{2} \cdot w - x4 + y \tag{4}$$

$$y5 = \frac{1}{2} \cdot w - x5 + y \tag{5}$$

y1–y5 are the positions 1–5 measured by flatness meter 11. The flatness meter 11 moves to the positions obtained based on equations (1)–(5) and keeps the positions until the strip 7 arrives at the positions.

If the strip 7 is rolled and reaches the position of flatness meter 11, specified by the measured positions determining controller 13, the flatness meter 11 measures strip flatness on the measured positions y1–y5.

Figure 4:
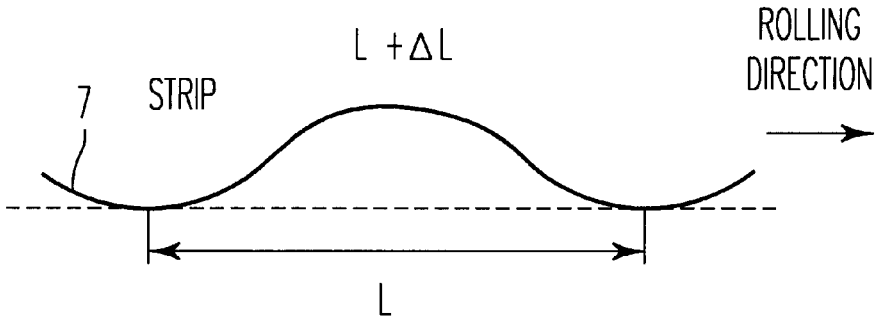
FIG. 4 is a diagram for explaining a definition of flatness in order to explain operation of the 1st embodiment.
Figure 5:
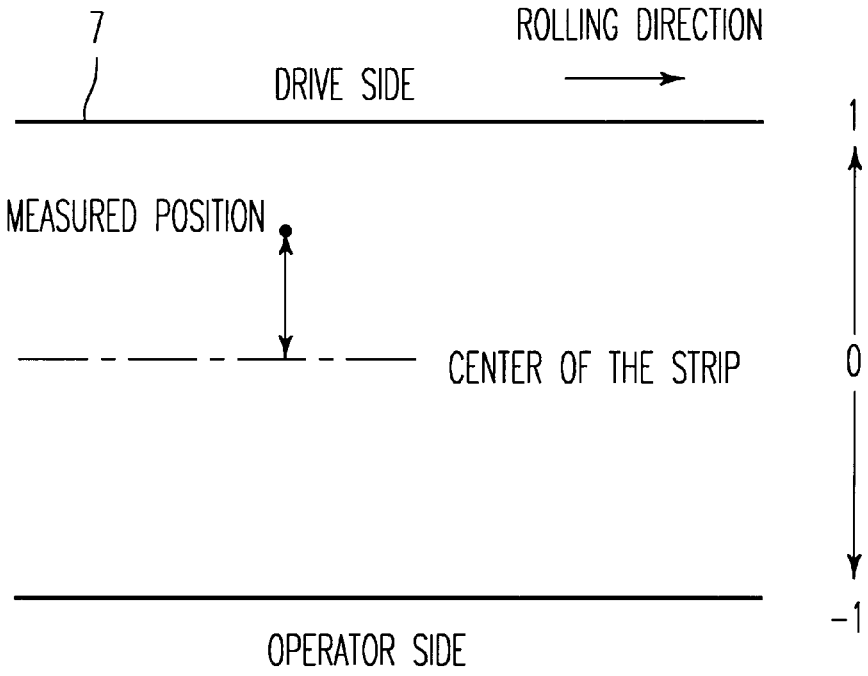
FIG. 5 is showing a strip standardized in order to explain operation of the 1st embodiment.

FIG. 4 is a side view of the strip 7. Flatness β is defined by the 70 following equations:

$$\beta = \frac{\Delta L}{L} \tag{6}$$

where

ΔL: elongation of the strip to standard length

L: Standard length

Flatness deviation Δβ is determined based on measured values on the positions 1–5 of flatness meter 11 and flatness reference values $\beta^{REF}$ by means for determining deviation 14, as the following equations (7) and (8).

$$\Delta\beta = \beta^{REF} - \frac{2 \cdot (\alpha 1 \cdot \beta 1 + \alpha 2 \cdot \beta 2 + \alpha 3 \cdot \beta 3 + \alpha 4 \cdot \beta 4 + \alpha 5 \cdot \beta 5)}{|\alpha 1| + |\alpha 2| + |\alpha 3| + |\alpha 4| + |\alpha 5|} \tag{7}$$

$$\alpha 1+\alpha 2+\alpha 3+\alpha 4+\alpha 5=0 \tag{8}$$

$\alpha_1$–$\alpha_5$ are constant so that equations (8) may be satisfied.

When the position 3 measures the center of the strip width and the positions 1 and 2 measure a drive side of the strip center and the positions 4 and 5 measure an operator side of strip center, $\alpha_1$, $\alpha_2$, $\alpha_4$, and $\alpha_5$ are same mark and $\alpha_3$=1:

$$\Delta\beta=\beta^{REF}-\{\beta 3-(-\alpha 1\cdot\beta 1-\alpha 2\cdot\beta 2-\alpha 4\cdot\beta 4-\alpha 5\cdot\beta 5)\} \tag{9}$$

$$\alpha 1+\alpha 2+\alpha 4+\alpha 5=-1 \tag{10}$$

Equations (9) and (10) may be the deformation of equations (7) and (8). If $\alpha_1=\alpha_5=0.5$, $\alpha_2=\alpha_4=0$, and $\alpha_{3=1}$, equation (10) will be satisfied and equation (7) is deformed equation (11):

$$\Delta\beta = \beta^{REF} - \left(\beta 3 - \frac{\beta 1 + \beta 5}{2}\right) \tag{11}$$

Thus, the deviations determining controller 14 calculates flatness deviations Δβ. However when flatness deviations Δβ is very small or very large, it is not necessary for the manipulated values determining controller 16 to output manipulated values to the work roll bending apparatus 9. When flatness deviations Δβ is very large, the operation is too large and the work roll bending apparatus 9 may be broken.

Therefore, the deviations determining controller 14 judges whether flatness deviations Δβ is in the permissible range defined beforehand, by (12) equations:

$$\Delta\beta_{min} \leqq \Delta\beta \leqq \Delta\beta_{max} \tag{12}$$

where $\Delta\beta_{min}$ and $\Delta\beta_{max}$ are constants.

When flatness deviations Δβ is satisfied equation (12), flatness is controlled, and when flatness deviations Δβ is not satisfied equation (12), the manipulated values determining controller 16 do not output manipulated values to work roll bending apparatus 9 and flatness is not controlled.

Thus, when flatness deviations Δβ is in the permission range defined beforehand, flatness is controlled. It is also desireable to stop flatness control when the difference between measured values on the drive side of center line and measured values on the operator side of center line is too large.

When the position 3 is on the center of the strip width and the positions 1 and 2 are on the drive side of the strip center and the positions 4 and 5 are on the operator side of strip center, $\Delta\beta^{DEF}$ is calculated by equation (13) and (14) using constant $\alpha_6$–$\alpha_9$.

$$\Delta\beta^{DIF}=(\alpha 6\cdot\beta 1+\alpha 7\cdot\beta 2)-(\alpha 8\cdot\beta 4+\alpha 9\cdot\beta 5) \tag{13}$$

$$\alpha 6+\alpha 7=\alpha 8+\alpha 9=1 \tag{14}$$

If $\Delta\beta^{DEF}$ is not in the permission range defined beforehand shown by equation (15). The flatness control may not be controlled when not satisfying the equation (15):

$$\Delta\beta_{min}{}^{DIF} \leqq \Delta\beta^{DIF} \leqq \Delta\beta_{MAX}{}^{DIF} \tag{15}$$

$\Delta\beta_{min}{}^{DIF}$ and $\Delta\beta_{max}{}^{DIF}$ are constants.

Next, the correction values determining controller 15 is explained.

In controlling flatness, the correction values $\Delta\beta^{COR}$ of the work roll bending apparatus 9 is calculated by the correction values determining controller 15, based on deviation Δβ calculated with the deviations determining means 14:

$$\Delta F_B^{COR} = G \cdot \frac{1}{\frac{\partial \beta}{\partial F_B}} \cdot G_T \cdot \Delta\beta \tag{16}$$

where

G: tuning gain $$\frac{\partial \beta}{\partial F_B};$$

The influence coefficients to flatness to change of work roll bending apparatus $G_T$: Time delay constant Influence coeffients in the equation (16) is calculated by next equations (17)–(21)

$$\frac{\partial \beta}{\partial F_B} = \left(\frac{\partial \beta}{\partial F_B}\right)_1 \cdot \left(\frac{\partial \beta}{\partial F_B}\right)_2 \cdot \left(\frac{\partial \beta}{\partial F_B}\right)_3 \cdot \left(\frac{\partial \beta}{\partial F_B}\right)_4 \tag{17}$$

$$\left(\frac{\partial \beta}{\partial F_B}\right)_1 = a1 + a2 \cdot x + a3 \cdot x^2 \tag{18}$$

$$\left(\frac{\partial \beta}{\partial F_B}\right)_2 = a4 + a5 \cdot \left(\frac{w}{1000}\right) + a6 \cdot \left(\frac{w}{10000}\right)^2 \tag{19}$$

$$\left(\frac{\partial \beta}{\partial F_B}\right)_3 = a7 + a8 \cdot \left(\frac{P}{w}\right) + a9 \cdot \left(\frac{P}{w}\right)^2 \tag{20}$$

$$\left(\frac{\partial \beta}{\partial F_B}\right)_4 = a10 + a11 \cdot h + a12 \cdot h^2 \tag{21}$$

where $a_1$–$a_{12}$: The constant determined beforehand by simulation etc.

x: Standardized width ($-1 \leqq x \leqq 1$)=2×(distance from center of strip to the position to evaluate)/(pre-set strip width values):(reference FIG. 5)

w: pre-set strip width values

P: pre-set rolling force h: pre-set thickness values

Equation (18) is explained about the position, equation (19) is explained about the strip width and equation (20) is explained about the thickness.

The influence coefficients which are described above change by center line error values.

The influence coefficients with consideration to center line error values can be found by equation (22):

$$\frac{\partial \beta}{\partial F_B} = \left(\frac{\partial \beta}{\partial F_B}\right)_1 \cdot \left(\frac{\partial \beta}{\partial F_B}\right)_2 \cdot \left(\frac{\partial \beta}{\partial F_B}\right)_3 \cdot \left(\frac{\partial \beta}{\partial F_B}\right)_4 \cdot \left(\frac{\partial \beta}{\partial F_B}\right)_5 \tag{22}$$

$$\left(\frac{\partial \beta}{\partial F_B}\right)_5 = a13 + a14 \cdot y + a15 \cdot y^2 \tag{23}$$

where $a_{13}$–$a_{15}$: The constant determined beforehand by simulation etc.

y: center line error values

The time delay constant $G_T$ in the equation (16) is calculated by equation (24):

$$G_T = \frac{1}{4 \cdot T_x + b} \tag{24}$$

where

Tx: strip transfer time from the rolling mill 6 to the flatness meter 11 b: regulation coefficient determined beforehand

The strip transfer time Tx is calculated by equation (25) using distance d from the rolling mill 6 to the flatness meter 11, forward slip f, and pre-set roll peripheral speed v.

$$T_x = \frac{d}{(1+f) \cdot v} \tag{25}$$

The roll peripheral speed v may be the value which multiplied rotations of rolling mill 6 by the diameter of a roll, without using the pre-set values.

Next, the manipulated values determining controller 16 is explained.

The Manipulated values $\Delta F_B$ of work roll bending apparatus 9 is obtained based on correction values $\Delta F_B^{COR}$ of equation (16) by the manipulated values determining controller 16.

The manipulated values determining controller 16 can consist of the PI controller with proportionality gain $K_p$ and the integral gain $K_I$, for example.

Furthermore, manipulated values determining means 16 judge whether adding manipulated values $\Delta F_B$ obtained by equation (16) to work roll bending apparatus 9 as it is, or adding corrected manipulated values $\Delta F_B$:

$$\Delta F_{Bmin} \leqq \Delta F_B \leqq \Delta F_{Bmax} \tag{26}$$

where $\Delta F_{Bmin}$: the pre-set minimum limit manipulated values $\Delta F_{Bmax}$: the pre-set maximum limit manipulated values When manipulated values $\Delta F_B$ is in the permission range of equation (26), manipulated values $\Delta F_B$ is added to work roll bending apparatus 9 as it is. When the manipulated values $\Delta F_B$ is smaller than minimum limit value $\Delta F_{Bmin}$, $\Delta F_B$ is corrected by next equation (27) and corrected $\Delta F_B$ is corrected and is added to work roll bending apparatus 9.

$$\Delta F_B = \Delta F_{Bmin} \tag{27}$$

If manipulated values $\Delta F_B$ is larger than maximum limit values $\Delta F_{Bmax}$, $\Delta F_B$ is corrected by next equation (28) and corrected $\Delta F_B$ is suppplied to the work roll bending apparatus 9.

$$\Delta F_B = \Delta F_{Bmin} \tag{28}$$

In this case, rate circuit which stop the change rate of the manipulated flatness values uniformly may be installed in the manipulated values determining means 16. For rate circuit, work roll bending force and flatness control can be stable.

This above first embodiment is applied to the rolling mill which the drive and operator side of work roll bending apparatus 9 are operated together. However, it is also applied to the rolling mill which the drive and operator side of work roll bending apparatus are operated independently. The manipulated values $\Delta\beta_{DR}$ of the drive side and the manipulated values $\Delta\beta_{OP}$ of the operator side are obtained by using equations (29)–(33).

The measured position 3, distance from the end of the strip 7, is calculated by equation (29).

$$x3 = \frac{1}{2} \cdot w \tag{29}$$

The position 1 and 2 measure the drive side of the strip center and the position 4 and 5 measure the operator side of strip center.

$$\Delta\beta_{DR} = \beta_{DR}^{REF} - \frac{2 \cdot (\alpha 10 \cdot \beta 1 + \alpha 11 \cdot \beta 2 + \alpha 12 \cdot \beta 3)}{|\alpha 10| + |\alpha 11| + |\alpha 12|} \tag{30}$$

$$\alpha 10 + \alpha 11 + \alpha 12 = 0 \tag{31}$$

$$\Delta\beta_{OP} = \beta_{OP}^{REF} - \frac{2 \cdot (\alpha 13 \cdot \beta 3 + \alpha 14 \cdot \beta 4 + \alpha 15 \cdot \beta 5)}{|\alpha 13| + |\alpha 14| + |\alpha 15|} \tag{32}$$

$$\alpha 13 + \alpha 14 + \alpha 15 = 0 \tag{33}$$

$\alpha_{10}$–$\alpha_{15}$ are pre-set constants so that equations (31) and (33) may be satisfied. Manipulated values $\Delta\beta_{DR}$ and $\Delta\beta_{OP}$ are supplied to work roll bending apparatus 9 which can regulate the bending power of a work roll independently at the drive and operator side.

Thus, according to this embodiment, flatness can be controlled by high accuracy when there is no strip in the center of line.

Figure 6:
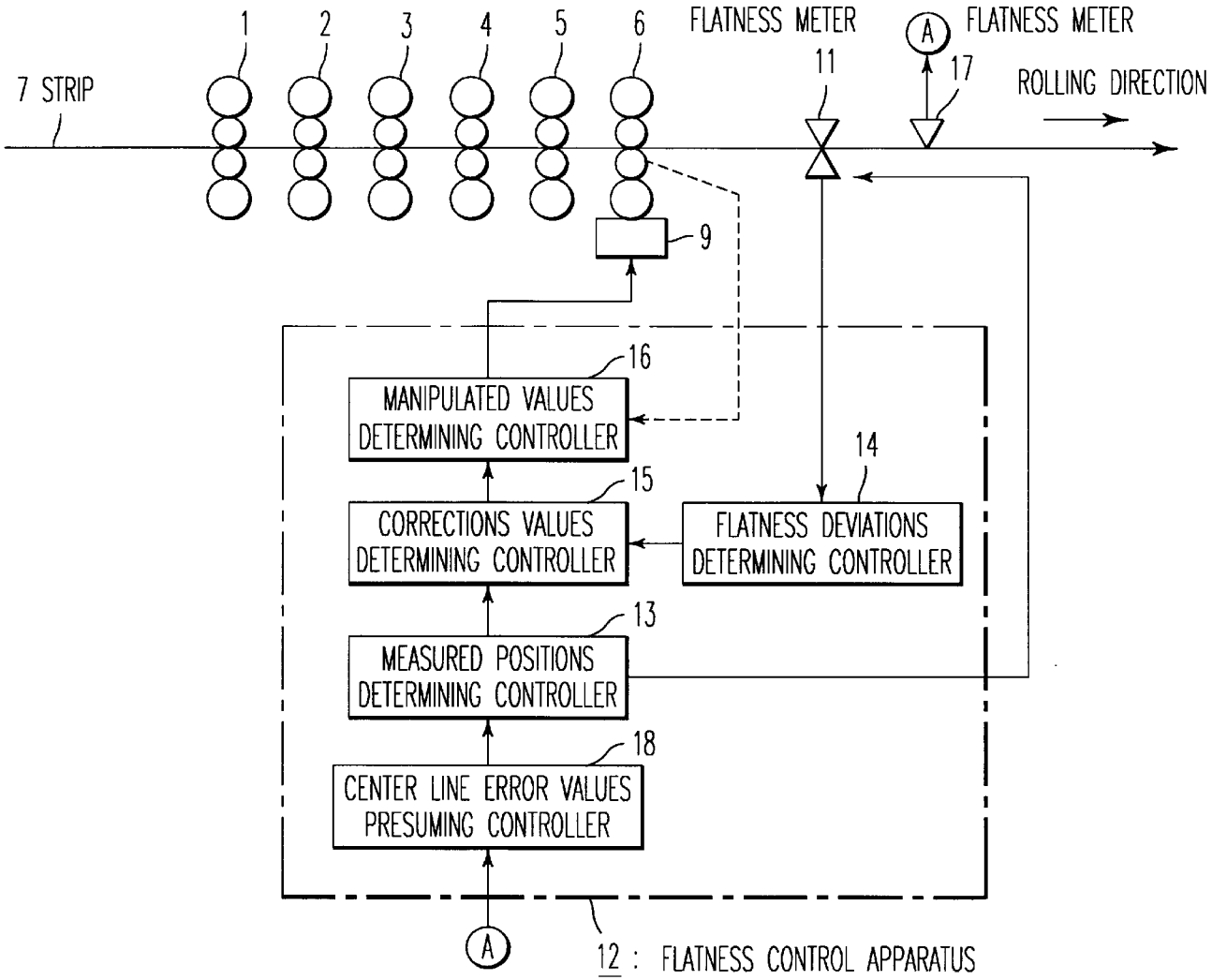
FIG. 6 is a block diagram showing the second embodiment of the present invention with rolling mill for application.

FIG. 6 is a block diagram showing the second embodiment of the present invention with rolling mill for application. The element in FIG. 6 which has the same function as FIG. 1 is attached the same mark and the explanation is omitted. In the first embodiment shown in FIG. 1, strip width meter 10 is installed on the entry side of rolling mill and strip flatness measured center line error values is controlled.

In the second embodiment shown in FIG. 6, center line error values of a previous strip is measured, the center line error values of the next strip is presumed, and the strip flatness is controlled, on the premise that rolling conditions of the strip 7 rolled one after another do not change greatly and the center line error values is almost equal.

A strip width meter 17 is installed on the delivery side of the mill 6 in the second embodiment shown FIG. 6. The Strip width meter 17 may be installed on either the delivery side or the entry side of the flatness meter 11.

The difference between FIG. 1 and FIG. 6 is that a center line error values presuming controller 18 calculates the center line error values of the next strip according to center line error values measured by the strip width meter 17.

The center line error values presuming controller 18 records center line error values of strip rolled one after another measured by the strip width meter 17 and presumes center line error values of the next strip based on the recorded center line error values. A method to presume is using measured center line error values of previous strip as the presumed values of center line error values of next strip. In this case, center line error values presuming means 18 is added measured center line error values of previous strip $y_0^{PRE}$ as the presumed center line error values of next strip to the measured positions determining controller 13.

The measured positions determining controller 13 determines the respective measured positions using presumed center line error values $y_0^{PRE}$ instead of center line error values y in the equations (1)–(5). Except for this determining the measured positions, the second embodiment is same as the first embodiment.

Thus second embodiment presumed center line error values of next strip based on center line error values of previous strip and it is able to control flatness by high accuracy when there is no strip in the center of line.

Figure 7:
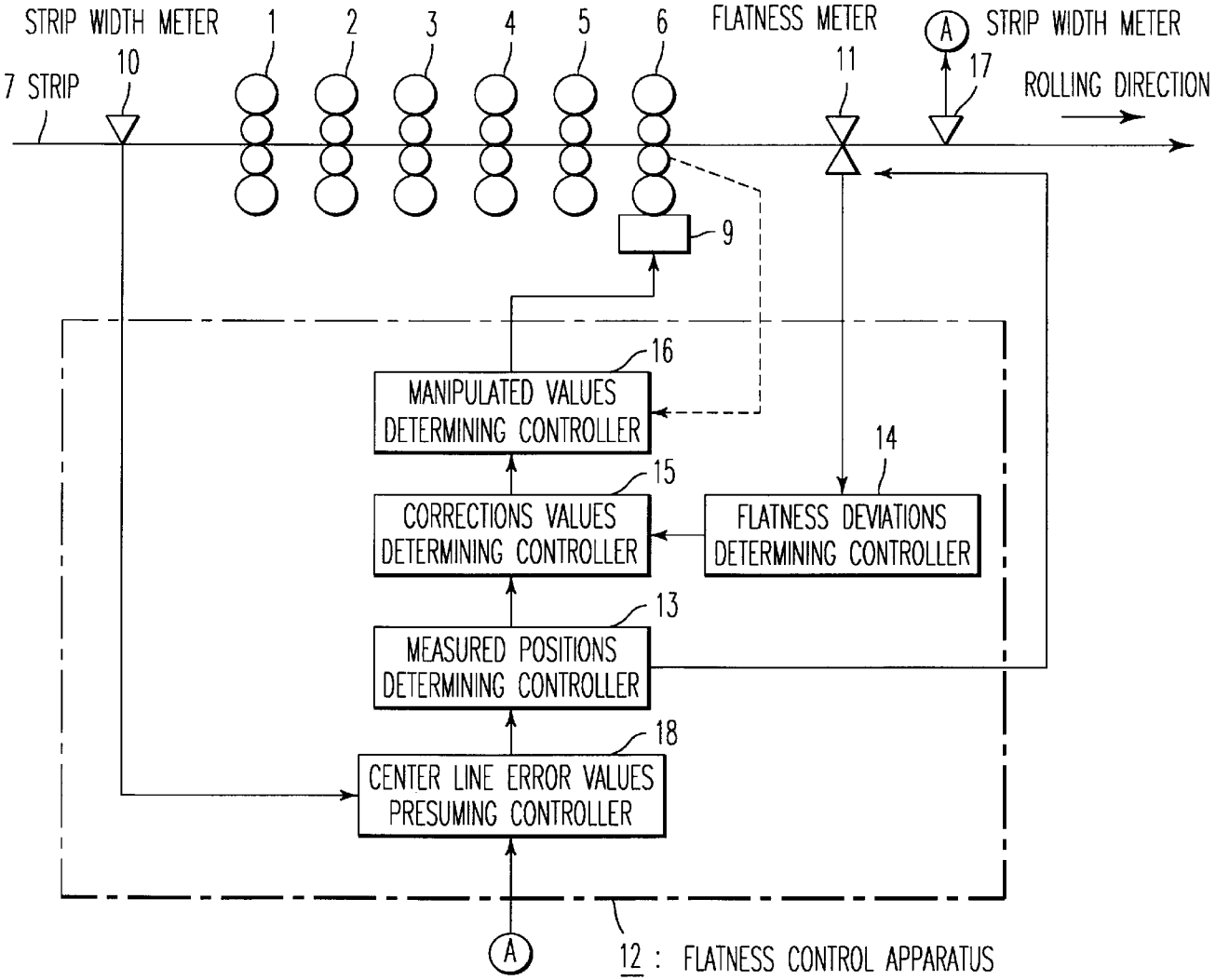
FIG. 7 is a block diagram showing the third embodiment of the present invention with rolling mill for application.

FIG. 7 is a block diagram showing the third embodiment of the present invention with rolling mill. Elements in FIG. 7 having the same function as FIG. 2 have the same mark and the explanation is omitted.

In this embodiment, a strip width meter 10 is installed on the entry side of the hot rolling and the center line error values presuming controller 18 presumes center line error values of the stand 6 based on the center line error values measured by the two strip width meters 10 and 17.

The center line error values of the strip rolled one after another measured by the respective strip width meter 10 and 17 is recorded by center line error values presuming means 18 and center line error values presuming means 18 presumed center line error values based on the recorded center line error values.

The center line error values of previous strip measured by strip width meter 10 installed on the entry side of hot mill is defined as $y_i^{PRE}$ and center line error values of previous strip measured by the strip width meter 17 installed on the delivery side of hot mill is defined as $y_0^{PRE}$ and the center line error values of next strip measured by strip width meter 10 installed on the entry side of hot mill is defined as $y_i^{CUR}$. The center line error values presuming means 18 is calculated the presumed center line error values $y_0^{CUR}$ of next strip, based on $y_i^{PRE}$, $y_0^{PRE}$ and $y_i^{CUR}$:

$$y_o^{CUR} = y_i^{CUR} + (y_o^{PRE} - y_i^{PRE}) \tag{34}$$

The presumed center line error values $y_0^{CUR}$ of the next strip is added to the measured positions determining controller 13. The measured positions determining means 13 determines the respective measured positions using presumed center line error values $y_0^{CUR}$ instead of center line error values y in the equations (1)–(5). Except for this determining of the measured positions, this embodiment is same as the first and second embodiments.

Thus, in the third embodiment shown FIG. 7, the difference between center line error values of the previous strip on the entry side of the mill and center line error values of the previous strip on the delivery side of the mill is added to presumed center line error values of next strip.

Therefore when there is difference between center line error values of the previous strip on the entry side of the mill and center line error values of the previous strip on the delivery side of the mill, flatness is controllable by high accurately.

Figure 8:
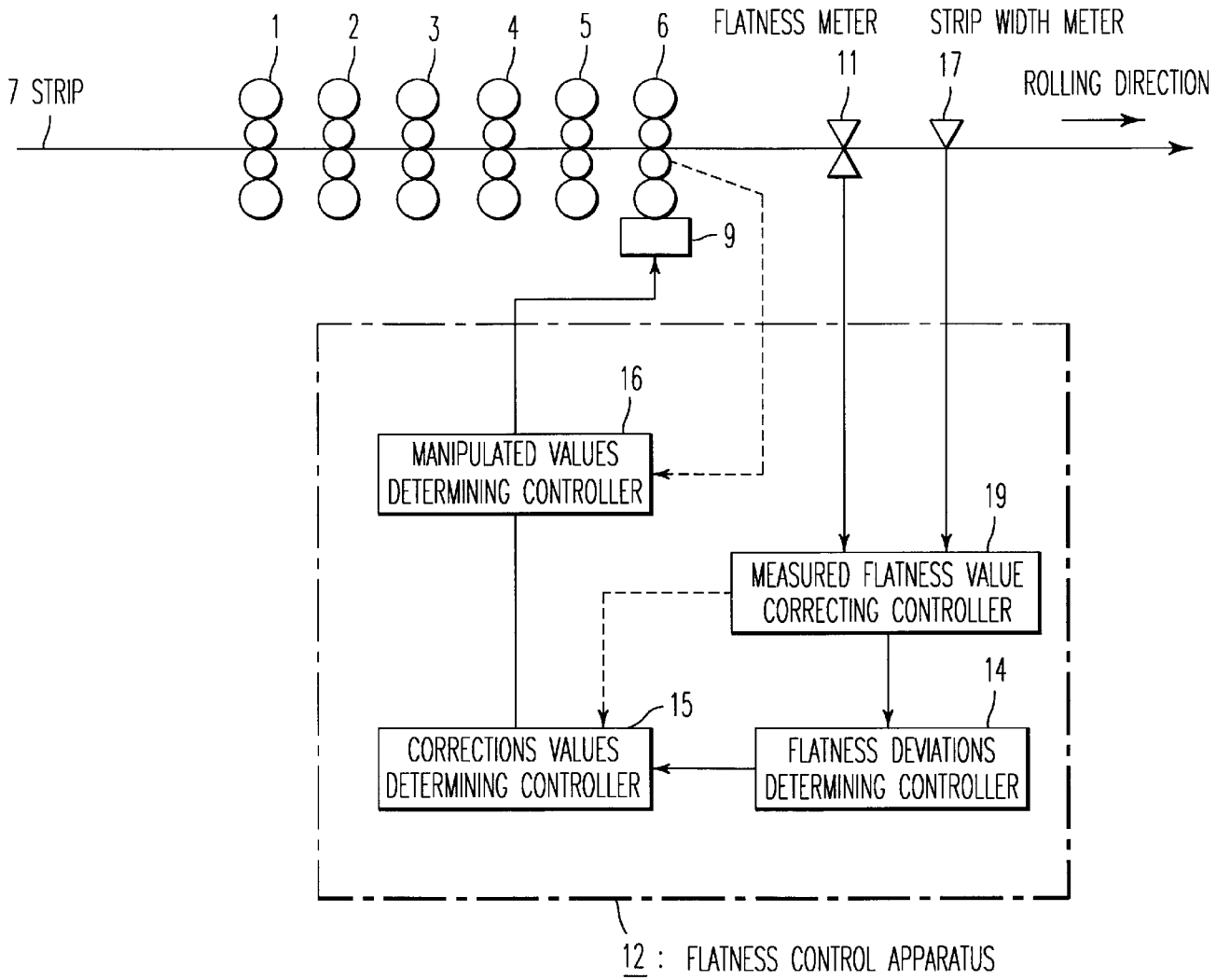
FIG. 8 is a block diagram showing the fourth embodiment of the present invention with rolling mill for application.

FIG. 8 is a block diagram showing the fourth embodiment of the present invention with rolling mill for application. The element in FIG. 8 which has the same function as FIG. 1 is attached the same mark and the explanation is omitted.

This embodiment has the measured flatness values correcting controller 19 without the measured positions determining means 13. Although in first, second, and third embodiments shown FIG. 1–7 the flatness meter 11 move, in fourth embodiment shown FIG. 8 flatness meter 11 do not move.

Therefore, gap of the measured position influence flatness measured by flatness meter 11 because of no strip in the center line, but the influence is corrected with measured center line error values of strip width meter 17 by measured flatness values correcting ocntroller 19.

The measured flatness values correcting controller 19 corrects the measured flatness by interpolation method or exterpolation method using measured flatness values $\beta_i$(i=1–5) of flatness meter 11 and center line error values $y_0$ by strip width meter 17:

(center line error values $y_0>0$)

$$\beta_1^{COR} = \frac{\beta_1 \cdot \{(x_2 - x_1) + y_0\} - \beta_2 \cdot y_0}{x_2 - x_1} \quad (35)$$

$$\beta_i^{COR} = \frac{\beta_{i-1} \cdot y_0 + \beta_i\{(x_i - x_{i-1}) - y_0\}}{x_i - x_{i-1}} \quad (i = 2 \sim 5) \quad (36)$$

(center line error values $y_0<0$)

$$\beta_i^{COR} = \frac{\beta_i \cdot \{(x_{i+1} - x_1) - (-y_0)\} + \beta_{i+1} \cdot (-y_0)}{x_{i+1} - x_i} \quad (i = 1 \sim 4) \quad (37)$$

$$\beta_5^{COR} = \frac{\beta_5 \cdot \{(x_5 - x_4) + (-y_0)\} + \beta_{i+1} \cdot (-y_0)}{x_5 - x_4} \quad (38)$$

The deviations determining controller 14 calculates flatness deviation $\Delta\beta$ as the first embodiment shown FIG. 1, using correction flatness values $\beta_i^{COR}$(i=1–5)instead of measured flatness values $\beta_i$(i=1–5). Except for this determining the measured positions, the fourth embodiment is same as the first embodiment.

Thus, in fourth embodiment shown FIG. 8 strip flatness is controlled by high accuracy when there is no strip in the center of line.

Moreover, in this embodiment flatness control apparatus 12 is the simple composition and the computer software which realizes the function is also few.

Although the above embodiments are applied to the four-high mill of 6 stands arranged in tandem, the present invention is not restricted to its application. The present invention is applicable to the six-high mill of 6 stands arranged in tandem instead of four-high mill of 6 stands arranged in tandem, the number of the mill arranged in tandem is fewer. In an extreme case, the present invention is applicable to a single stand.

Moreover, although rolling mill which controls flatness is the rolling mill of the final stand, any rolling mill arranged in tandem may control flatness.

When for a certain reason the strip is rolled without using rolling mill of the final stand, flatness control is often performed by rolling mill in front of the one. This invention is applicable also to such hot rolling mill.

The work roll bending apparatus is described as the actuator for controlling flatness. However, flatness control can be performed by using the crossing angle control apparatus which makes an upper and lower roll cross in the rolling direction mutually, the roll shift equipment which moves an upper and lower roll in the direction of the axis of a roll mutually, etc.

As for this invention, center line error values of the strip is measured by strip width meter, the measured positions of flatness meter is determined based on the measured center line error values and pre-set strip width values and manipulated actuator values for flatness control is determined based on deviations between the measured flatness values of flatness meter and flatness reference values. Therefore, when there is no strip in the central part of line, flatness control can be realized in high accuracy.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A flatness control apparatus for a hot rolling mill, comprising:

a strip width meter, installed on an entry side of the hot rolling mill, configured to measure center line error values of a strip;

a flatness meter, installed on a delivery side of the hot rolling mill configured to measure flatness of the strip;

an actuator configured to control the flatness of the strip;

means for determining positions on the strip at which to measure the flatness with the flatness meter based on the center line error values and pre-set strip width values;

means for determining deviations between measured flatness values and pre-set flatness reference values;

means for determining correction actuator values based on the deviations; and means for determining manipulated actuator values based on the correction actuator values.

2. A flatness control apparatus according to claim 1, wherein the measured flatness values are obtained by subtracting the measured flatness values at a position between a center of the strip and an end of the strip from the measured flatness values at the center of the strip.

3. A flatness control apparatus according to claim 1, wherein the means for determining manipulated actuator values stops outputting the manipulated actuator values to the actuator when the deviations between the measured flatness values and the pre-set flatness reference values are not in a permissible range.

4. A flatness control apparatus according to claim 1, wherein the means for determining manipulated actuator values stops outputting the manipulated actuator values to the actuator when the deviations obtained by subtracting the measured flatness values at a position between a center of the strip and an end of the strip from the measured flatness values at the center of the strip are not in a permission range.

5. A flatness control apparatus according to claim 1, wherein the means for determining correction actuator values controls the flatness using influence coefficients of the actuator and the deviations.

6. A flatness control apparatus according to claim 1, wherein the means for determining correction actuator values controls the flatness using influence coefficients of the actuator and the deviations, the influence coefficients being determined by target strip width values, target strip thickness values, and presumed rolling force.

7. A flatness control apparatus according to claim 1, wherein the means for determining correction actuator values controls the flatness using influence coefficients based on the center line error values.

8. A flatness control apparatus according to claim 1, wherein the means for determining correction actuator values calculates the correction actuator values by multiplying the deviations by a time delay constant, the time delay constant being calculated from a strip transfer time.

9. A flatness control apparatus according to claim 1, wherein the means for determining correction actuator values calculates the correction actuator values by multiplying the deviations by a time delay constant according to a strip velocity obtained from a distance between the hot rolling mill with the actuator and the flatness meter, a pre-set roll peripheral speed, and a presumed forward slip.

10. A flatness control apparatus according to claim 1, wherein the means for determining correction actuator values calculates the correction actuator values by multiplying the deviations by a time delay constant according to a strip velocity obtained from rotations of the hot rolling mill with the actuator at a pre-set diameter of a roll and a presumed forward slip.

11. A flatness control apparatus according to claim 1, wherein the means for determining manipulated actuator values sets the manipulated actuator values to limit values when the manipulated actuator values are not in a permission range.

12. A flatness control apparatus according to claim 1, wherein the means for determining manipulated actuator values includes a rate circuit which stops a change rate of the manipulated flatness values uniformly.

13. A flatness control apparatus according to claim 1, wherein the actuator controls the flatness independently on a drive side and an operator side of the hot rolling mill, based on the measured flatness values at a center of the strip, the measured flatness values at a position from the center of the strip to the drive side of the hot rolling mill, and the measured flatness values at a position from the center of the strip to the operator side of the hot rolling mill.

14. A flatness control apparatus for a hot rolling mill, comprising:

a strip width meter, installed on a delivery side of the hot rolling mill, configured to measure center line error values of a strip;

a flatness meter, installed on the delivery side of the hot rolling mill, configured to measure flatness of the strip;

an actuator configured to control the flatness of the strip;

means for presuming center line error values of a next strip based on center line error values of a previous strip, the next strip rolled after the previous strip;

means for determining positions on the next strip at which to measure the flatness with the flatness meter based on the center line error values of the next strip and pre-set strip width values;

means for determining deviations between measured flatness values and pre-set flatness reference values;

means for determining correction actuator values based on the deviations; and means for determining manipulated actuator values based on the correction actuator values.

15. A flatness control apparatus for a hot rolling mill, comprising:

a first strip width meter, installed on an entry side of the hot rolling mill, configured to measure first center line error values of a strip;

a second strip width meter, installed on a delivery side of the hot rolling mill, configured to measure second center line error values of a strip;

a flatness meter, installed on the delivery side of the hot rolling mill, configured to measure flatness of the strip;

an actuator configured to control the flatness of the strip;

means for presuming center line error values of a next strip based on first center line error values of the next strip and first center line error values of a previous strip, and second center line error values of the previous strip, the next strip rolled after the previous strip;

means for determining positions on the next strip at which to measure the flatness with the flatness meter based on the center line error values of the next strip presumed by the means for presuming and pre-set strip width values;

means for determining deviations between measured flatness values and pre-set flatness reference values;

means for determining correction actuator values based on the deviations; and means for determining manipulated actuator values based on the correction actuator values.

16. A flatness control apparatus for a hot rolling mill, comprising:

a strip width meter, installed on a delivery side of the hot rolling mill, configured to measure center line error values of a strip;

a flatness meter, installed on the delivery side of the hot rolling mill, configured to measure flatness of the strip;

an actuator configured to control a flatness of the strip:

means for correcting measured flatness values of the flatness meter based on the center line error values;

means for determining deviations between the measured flatness values corrected by the means for correcting and pre-set flatness reference values;

means for determining correction actuator values based on the deviations; and means for determining manipulated actuator values based on the correction actuator values.

* * * * *